US011719444B2

(12) United States Patent
Humphrey et al.

(10) Patent No.: US 11,719,444 B2
(45) Date of Patent: Aug. 8, 2023

(54) WATER HEATER WITH INTEGRATED BUILDING RECIRCULATION CONTROL

(71) Applicant: RINNAI AMERICA CORPORATION, Peachtree City, GA (US)

(72) Inventors: Scott Gilman Humphrey, Newnan, GA (US); Michael Scott Knoblett, Newnan, GA (US); Jason William Siler, Sharpsburg, GA (US)

(73) Assignee: RINNAI AMERICA CORPORATION, Peachtree City, GA (US)

( * ) Notice: Subject to any disclaimer, the term of this patent is extended or adjusted under 35 U.S.C. 154(b) by 0 days.

(21) Appl. No.: 17/861,906

(22) Filed: Jul. 11, 2022

(65) Prior Publication Data

US 2022/0373192 A1 Nov. 24, 2022

Related U.S. Application Data

(63) Continuation of application No. 17/000,076, filed on Aug. 21, 2020, now Pat. No. 11,384,944.

(60) Provisional application No. 62/890,974, filed on Aug. 23, 2019.

(51) Int. Cl.

| | |
|---|---|
| ***F24H 1/10*** | (2022.01) |
| ***F24D 17/00*** | (2022.01) |
| ***F24D 19/10*** | (2006.01) |

(52) U.S. Cl.

CPC ..... *F24D 17/0078* (2013.01); *F24D 19/10* (2013.01); *F24D 2240/00* (2013.01)

(58) Field of Classification Search

CPC .... F24H 1/10; F24H 9/20; F22B 29/02; F22B 37/34

See application file for complete search history.

(56) References Cited

U.S. PATENT DOCUMENTS

| | | | | |
|---|---|---|---|---|
| 9,063,551 | B2 * | 6/2015 | Deivasigamani | G05D 23/1904 |
| 9,702,585 | B2 * | 7/2017 | Hayden | F24H 1/103 |
| 9,909,780 | B2 | 3/2018 | Humphrey et al. | |
| 10,895,405 | B2 * | 1/2021 | Mahajan | F24H 9/146 |

(Continued)

*Primary Examiner* — Gregory A Wilson

(74) *Attorney, Agent, or Firm* — Meunier Carlin & Curfman LLC

(57) ABSTRACT

A water heater system includes a controller configured to integrate control of both recovery and recirculation operations of a recovery pump and a recirculation pump. As such, a separate device, installation location, and power source (e.g., available outlet) is not needed with the controller. Because a single controller is configured to control both recovery and recirculation operations, additional control functions are available. The controller may be in communication with an internal controller of the water heater and configured to receive an error notification upon abnormal operation of the water heater. The controller can stop recovery and recirculation operations in response to an error notification, unlike with traditional water heating systems which may otherwise continue to function. The recovery and recirculation operations are based on a setpoint temperature of the water heater such that changes made to the setpoint temperature will automatically adjust in the recovery and recirculation operations.

19 Claims, 6 Drawing Sheets

(56) References Cited

U.S. PATENT DOCUMENTS

| | | | | |
|---|---|---|---|---|
| 2008/0265046 | A1* | 10/2008 | Grimes | F24D 17/0078<br>237/19 |
| 2018/0073749 | A1* | 3/2018 | Gagne | F24D 19/1069 |
| 2019/0293303 | A1* | 9/2019 | Zhang | F24D 19/106 |
| 2021/0033287 | A1* | 2/2021 | Chaudhry | F24D 19/1015 |
| 2021/0095866 | A1* | 4/2021 | Chaudhry | F24D 19/1051 |

* cited by examiner

WATER HEATER WITH INTEGRATED BUILDING RECIRCULATION CONTROL

CROSS REFERENCE TO RELATED APPLICATIONS

This application is a continuation of U.S. patent application Ser. No. 17/000,076, filed Aug. 21, 2020, which claims priority to U.S. Provisional Patent Application Ser. No. 62/890,974 filed Aug. 23, 2019, the disclosures of which are expressly incorporated herein by reference.

BACKGROUND

The need for heated fluids, and in particular heated water, has long been recognized. Conventionally, water has been heated by heating elements, either electrically or with gas burners, while stored in a tank or reservoir. While effective, energy efficiency and water conservation using a storage tank alone can be poor. As an example, water that is stored in a hot water storage tank is maintained at a desired temperature at all times.

Many of the disadvantages associated with traditional hot water storage tanks have been overcome by the use of tankless water heaters. With the tankless water heater, incoming ground water passes through a component generally known as a heat exchanger and is instantaneously heated by heating elements (or gas burner) within the heat exchanger until the temperature of the water leaving the heat exchanger matches a desired temperature set by a user of the system. With such systems the heat exchanger is typically heated by a large current flow (or Gas/BTU input) which is regulated by an electronic control system. The electronic control system also typically includes a temperature selection device, such as a thermostat, by which the user of the system can select the desired temperature of the water being output from the heat exchanger.

Plumbing networks often utilize a separate recirculation pump in a return line of a hot water recirculation circuit to maintain water in the hot water recirculation circuit at a desired hot water temperature. A separate recirculation controller and temperature sensor typically controls the recirculation pump for periodic operation.

SUMMARY

Various implementations include a water heating system. The water heating system includes recirculation controller. The recirculation controller is configured to receive a water heater output temperature of a water heater from a first temperature sensor. The recirculation controller is configured to receive a recirculation temperature of a building recirculation return pipe from a second temperature sensor. The recirculation controller is configured to control a recovery pump for circulating water between the water heater and a storage tank based on the water heater output temperature and a storage tank temperature. The recirculation controller is configured to control a building recirculation pump configured to circulate water between the storage tank and the building recirculation return pipe based on the water heater output temperature and the recirculation temperature.

In some implementations, the recirculation controller is configured to turn off the building recirculation pump upon a determination that the recirculation temperature is at least at a comparison value that is based on the water heater output temperature.

In some implementations, the recirculation controller is further configured to maintain operation of the building recirculation pump upon a determination the recirculation temperature is less than the comparison value.

In some implementations, the recirculation controller is configured to turn off the building recirculation pump in response to receiving a water heater error notification from an internal controller of the water heater.

In some implementations, the recirculation controller is configured to calculate the comparison value based on an offset value from the water heater output temperature.

In some implementations, the offset value is ten to thirty degrees.

Various other implementations include a hot water circulation system. The hot water circulation system includes a water heater having an inlet and an outlet. The hot water circulation system includes a storage tank having a tank inlet configured to be fluidically coupled to a water source, a recovery inlet fluidically coupled to the water heater outlet, a recovery outlet fluidically coupled to the water heater inlet, and a tank outlet configured to be coupled to a plumbing network. The hot water circulation system includes a recovery pump fluidically coupled to the water heater outlet. The hot water circulation system includes a building recirculation pump, having an inlet and an outlet, wherein the building recirculation pump is configured to be fluidically coupled to the tank inlet, wherein the inlet of the building recirculation pump is configured to be coupled to an outlet of the plumbing network. The hot water circulation system includes a first temperature sensor disposed in a location downstream of the water heater outlet. The hot water circulation system includes a second temperature sensor configured to measure a temperature about the building recirculation pump, and a building recirculation controller. The recirculation controller is configured to receive a heater output temperature from the first temperature sensor, and a recirculation temperature from the second temperature sensor. The recirculation controller is configured to control a building recirculation pump based on the heater output temperature and the recirculation temperature.

In some implementations, the recirculation controller is configured to turn off the building recirculation pump upon a determination that the recirculation temperature is at least a comparison value. The comparison value is based on the heater output temperature.

In some implementations, the recirculation controller is further configured to maintain operation of the building recirculation pump upon a determination the recirculation temperature is less than the comparison value.

In some implementations, the water heater further comprises an internal controller. The recirculation controller is configured to turn off the building recirculation pump in response to receiving a water heater error notification from a water heater internal controller.

In some implementations, the recirculation controller is configured to deactivate the recovery pump in response to receiving the error notification from the water heater internal controller.

In some implementations the hot water circulation system includes a third temperature sensor, configured to measure a storage tank temperature inside the storage tank. The recirculation controller is configured to activate the recovery pump upon a determination that the pump outlet temperature exceeds the storage tank temperature by a predetermined value.

In some implementations, the recirculation controller is configured to maintain functions of the building recirculation pump, in response to the recirculation temperature.

In some implementations, the recirculation controller is configured to compare the tank temperature to a comparison value. The comparison value is calculated using the heater outlet temperature and an offset value to determine whether to run the recovery pump and the building recirculation pump.

In some implementations, the comparison value is the heater outlet temperature, minus the comparison value, plus ten degrees. In some implementations, the water heater is activated by a fluid flow produced from the building recirculation pump, or the recovery pump.

In some implementations, the water heater internal controller is in electrical communication with the recirculation controller.

Various other implementations include a method of providing hot water. The method includes receiving an input to activate a building recirculation pump. The method includes, receiving a heater output temperature from a first temperature sensor, where first temperature sensor is disposed downstream of a water heater output. The method includes receiving a recirculation temperature from a second temperature sensor, wherein the second temperature sensor is disposed about a building recirculation pump within a plumbing network. The method includes comparing the recirculation temperature to a comparison value that is calculated based on the heater output temperature. The method includes maintaining operation of the building recirculation pump upon a determination that the recirculation temperature is less than the comparison value. The method includes turning off the building recirculation pump upon a determination that the recirculation temperature is at least at the comparison value.

In some implementations, the method of providing hot water includes turning off the building recirculation pump in response to receiving a water heater error notification from a water heater internal controller.

In some implementations, the method of providing hot water includes turning off the building recirculation pump after a set time interval.

DETAILED DESCRIPTION

It should be understood at the outset that although illustrative implementations of one or more embodiments are illustrated below, the disclosed systems and methods may be implemented using any number of techniques, whether currently known or in existence. Like numbers represent like parts throughout the various figures, the description of which is not repeated for each figure. The disclosure should in no way be limited to the illustrative implementations, drawings, and techniques illustrated below, but may be modified within the scope of the appended claims along with their full scope of equivalents. Use of the phrase "and/or" indicates that any one or any combination of a list of options can be used. For example, "A, B, and/or C" means "A", or "B", or "C", or "A and B", or "A and C", or "B and C", or "A and B and C".

A water heater system includes a controller configured to manage operations of a recovery pump for circulating hot water between a water heater and a hot water storage tank. Conventionally, a separate temperature sensor and controller combination device, such as an aquastat, may control a recirculation pump for recirculating hot water through a building's hot water recirculation circuit. The controller of the pending disclosure integrates functions of the aquastat device to control both recovery and recirculation operations. As such, a separate device, installation location, and power source (e.g., available outlet) is not needed with the controller of the pending disclosure. Water heater systems may be often installed in tight quarters within a building's infrastructure where installation of separate devices into the available space may be cumbersome and inhibit installation in some applications.

Additionally, because a single controller is configured to control both recovery and recirculation operations, additional control functions are available. For example, the controller of the pending disclosure may be in communication with a controller of the water heater and configured to receive an error notification upon abnormal operation of the water heater. As such, the controller of the pending disclosure can integrate error notifications from the water heater into the recovery and recirculation control functions. Therefore, the controller of the pending application may stop recovery and recirculation operations in response to an error notification, unlike with traditional water heating systems which may otherwise continue to function and require user intervention in the event of an error in the water heater.

Figure 1:
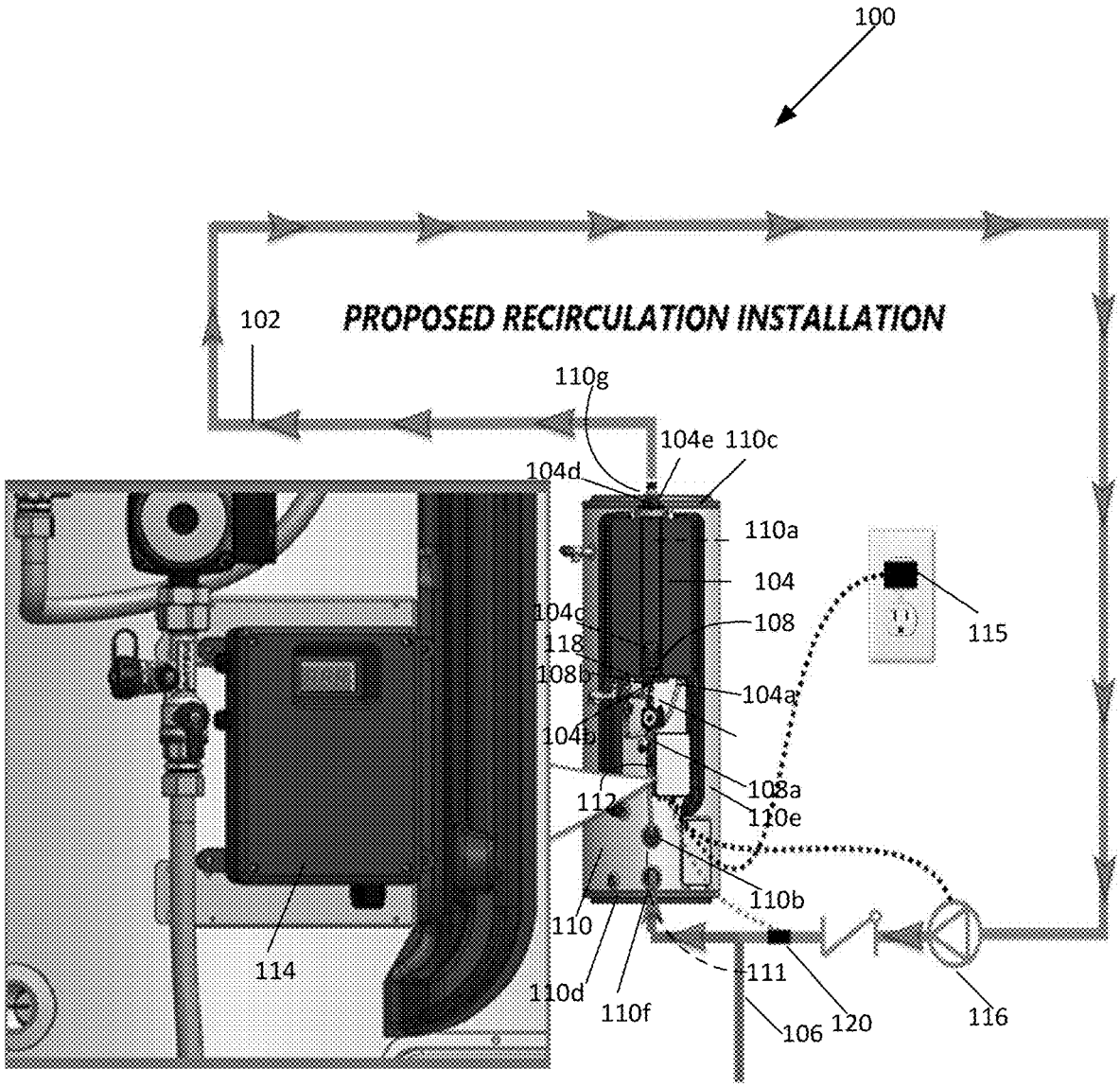
FIG. 1 is a system diagram of a hot water circulation system with a recirculation controller for controlling both a recirculation pump and a recovery pump.

FIG. 1 shows a hot water circulation system 100 that includes a water heater 104, a recovery pump 108, a storage tank 110, a recirculation controller 114, and a recirculation pump 116. The water heater 104 has an inlet 104*a* and an outlet 104*b*.

In some implementations, the water heater 104 is a tankless water heater that is activated by a flow of water running through it, between the inlet 104*a* and the outlet 104*b*. In some implementations, the water heater 104 is maintained in an off state until it senses water running through an internal heat exchanger. In some implementations, the internal heat exchanger utilizes heating elements. The heating elements may include gas burners or electric heating elements to produce heat for exchange with water flowing through the internal heat exchanger.

When the heat exchanger uses a gas burner, the water heater 104 additionally includes a vent stack 104*d* for venting exhaust from the gas burner. The temperature of the exhaust may increase as the temperature of water received from the inlet 104*a* increases. High exhaust temperatures may be particularly prone to occurrence when a setpoint temperature of the water heater 104 is high (e.g., greater than 120 degrees Fahrenheit). Under such conditions, the heating element may supply a large amount of heat, but may result in a low temperature difference between high temperature water at the inlet 104*a* and water supply from the outlet 104*b*, thereby causing excess heat to be removed via the exhaust vent 104*d*. Above a threshold exhaust temperature (e.g., 160 degrees Fahrenheit), damage may be caused to the vent stack 104*d*. Accordingly, a fourth temperature sensor 104*e* may be located in the vent stack for monitoring the exhaust temperature. In various implementations, an internal controller 104*c* of the water heater 104 monitors the exhaust temperature from the fourth temperature sensor 104*e*.

The water heater 104 is maintained in an on state while it senses that water is flowing through the internal heat exchanger, and the water heater 104 deactivates once the water heater 104 senses that water is no longer running through the internal heat exchanger. Other control methods for turning on or off the water heater 104 are contemplated by this disclosure. For example, the water heater 104 may receive one or more control signals to start or stop operation of the water heater 104. The control signals may be received from a user interface on the water heater 104 or from a remote source, such as from a mobile application on a smartphone.

The water heater 104 also has an internal controller 104*c* which controls internal functions of the water heater 104 and is configured to electronically transmit an error notification to at least one external device. The error notification communicates system errors pertaining to internal functions of the water heater 104. For example, an error in the operation of the heat exchanger or a heating element may result in the water heater 104 not being able to supply hot water at a configured setpoint temperature. Accordingly, the water heater 104 may turn off and communicate the error notification to an external device. The water heater 104 can be coupled to an external device through a wired or wireless connection.

The recovery pump 108 has an outlet 108*b* that is coupled to the inlet 104*a* of the water heater 104. The recovery pump 108 is a water pump that is configured to pump water through a plumbing system. In some implementations, the recovery pump 108 pumps water at a user-set flow rate, or at a variable flow rate which is continuously controlled electronically. In operation, the recovery pump 108 circulates hot water between the water heater 104 and the storage tank 110. Cold water supplied by the outlet 108*b* of the recovery pump 108 is provided to the water heater 104 from the storage tank 110. Cold water is drawn from a recovery outlet 110*b* of the storage tank 110 and supplied by the recovery pump 108 to the water heater 104 to be heated therein. As the recovery pump 108 operates, the volume of hot water stored within the storage tank 110 increases until a maximum temperature is detected by a first temperature sensor 111 disposed about a bottom section of the storage tank 110.

The storage tank 110 has a recovery inlet 110*a*, the recovery outlet 110*b*, a top 110*c*, a bottom 110*d*, and a cylindrical wall 110*e*. The storage tank 110 also has a cold water supply inlet 110*f* and a hot water outlet 110*g*. The cold water supply inlet 110*f* receives cold water from a water source 106, such as a municipal water supply and/or a return line of a hot water recirculation loop 102. In some implementations, the water heater outlet 110*g* supplies hot water from the storage tank 110 to the hot water recirculation loop 102 of a building's plumbing system. The outlet 104*b* of the water heater 104 is fluidically coupled to the recovery inlet 110*a* of the storage tank 110.

The cylindrical wall 110*e* is disposed between the top 110*c* and the bottom 110*d* of the storage tank 110 and encloses a volume. The storage tank 110 is configured to hold a volume of fluid. The storage tank 110 is configured to limit the rate that heat escapes the storage tank 110. For example, the cylindrical wall 110*e* can be surrounded by insulation, which prevents some heat from escaping the storage tank 110. An upper portion of the storage tank 110 is disposed closer to the top 110*c* of the storage tank 110, and a lower portion is disposed closer to the bottom 110*d* of the storage tank 110. The upper portion and the lower portion are fluidically connected, where water in the upper portion can freely mix with water in the lower portion. The recovery inlet 110*a* is disposed on the cylindrical wall 110*e* of the storage tank 110 near the top 110*c* of the storage tank 110 in the upper portion of the storage tank 110. In the example shown in FIG. 1, the recovery inlet 110*a* is not visible due to placement of the water heater 104 over the recovery inlet 110*a*, as indicated by the dotted lead line for the recovery inlet 110*a*. The recovery outlet 110*b* is disposed on the cylindrical wall 110*e* of the storage tank 110 near the bottom 110*d* of the storage tank 110 in the lower portion of the storage tank 110. In some implementations, the recovery inlet 110*a* is disposed on the upper portion of the storage tank 110, and the recovery outlet 110*b* is disposed on the lower portion of the storage tank 110.

The recovery inlet 110*a* receives hot water from the outlet 104*b* of the water heater 104 to be stored in the storage tank 110. The recovery outlet 110*b* supplies cold water to the water heater inlet 104*a*. Although FIG. 1 shows the recovery outlet 110*b* coupled to a water pipe 112, the recovery outlet 110*b* can be coupled to pipe, a valve, or any other plumbing fixture that can release water from the storage tank 110.

During operation of the recovery pump 108, cold water is drawn from the recovery outlet 110*b* of the storage tank 110 through the inlet 108*a* of the recovery pump 108. The recovery pump 108 supplies the cold water through the outlet 108*b* of the recovery pump 108 to the inlet 104*a* of the water heater 104. Hot water produced by the water heater 104 is circulated from the outlet 104*b* of the water heater 104 to the recovery inlet 110*a* of the storage tank 110 for storage therein.

The recirculation controller 114 is configured to control the functions of the recovery pump 108. The recirculation controller 114 is also configured to control the functions of a recirculation pump 116. The recirculation controller 114 is electrically connected to the recovery pump 108 and the recirculation pump 116. The recirculation controller 114 is configured to receive several temperature readings and control the functions of the recirculation pump 116 and the recovery pump 108 in response to the temperature readings. The recirculation controller 114 is also configured to calculate activation and deactivation values, using preset values and measured temperature values (described in FIGS. 3-5). The recirculation controller 114 is electronically coupled to various external electrical components, such as the internal controller 104*c* of the water heater 104. Although a physical electrical connection is shown in FIG. 1, the recirculation controller 114 can also be connected to external electrical components using a wireless connection such as ZigBee, Bluetooth, Wi-Fi, or any other communication method.

The recirculation controller 114 has a single power chord 115 connection, that can be plugged into a building power supply, powering the recirculation controller 114. Additionally, the recirculation controller 114 can supply electrical power to the recovery pump 108 and the recirculation pump 116, such that only one power outlet is required to operate the recirculation controller 114, the recovery pump 108, and the recirculation pump 116.

In some implementations, the hot water recirculation system 100 further includes a second temperature sensor 118 disposed about the outlet 104*b* of the water heater 104, and a third temperature sensor 120, disposed about the recirculation pump 116. In some implementations the first temperature sensor 111, the second temperature sensor 118, and the third temperature sensor 120, are each a thermistor. In other implementations, one or more of the temperature sensors 111, 118, 120 may be a thermocouple, or any other type of temperature sensor that can sense water temperature.

The recirculation controller 114 is electrically connected to each of the first, second, and third temperature sensors 111, 118, 120 and configured to receive one or more signals indicative of a temperature sensed by the corresponding temperature sensors. In some implementations the temperature sensors 111, 118, 120 receive power from the recirculation controller 114 and therefore do not require any additional power source. The first temperature sensor 111 sends one or more signals to the recirculation controller 114 indicating a tank temperature about the recover outlet 110*b* of the storage tank 110. In the example shown in FIG. 1, the first temperature sensor 111 is disposed at a location proximate to and above the recovery outlet 110*b* of the storage tank 110. Within the context of this disclosure, "above" is in a direction from the recovery outlet 110*b* to the recovery inlet 110*a*. The first temperature sensor 111 is disposed inside the storage tank 110 and measures the temperature of the water that flows out of the recovery outlet 110*b*. Although FIG. 1 shows the first temperature sensor 111 disposed at a location inside the storage tank 110, the first temperature sensor 111 can be disposed outside the recovery outlet 110*b*, on a plumbing fixture coupled to the recovery outlet 110*b*, or at any location that allows the first temperature sensor 111 to read the temperature about the lower portion of the storage tank 110. For example, the first temperature sensor 111 can be disposed at a location on a water pipe that is fluidically coupled between the recovery outlet 110*b* and the water heater inlet 104*a*.

The second temperature sensor 118 sends one or more signals to the recirculation controller 114 indicating a heater output temperature of hot water produced by the water heater 104. Therefore, the temperature sensed by the second temperature sensor is the setpoint temperature of the water heater 104. The second temperature sensor 118 is disposed about the outlet 104*b* of the water heater 104. For example, the second temperature sensor 118 may be housed within the water heater 104 or positioned on a pipe coupled to the outlet 104*b* of the water heater 104. In some implementations, the second temperature sensor 118 may be disposed within the water heater 104 and monitored by the internal controller 104*c*. As discussed below, parameters monitored by the internal controller 104*c* may be communicated to the recirculation controller 114 via a data connector. The third temperature sensor 120 sends one or more signals to the recirculation controller 114 indicating a temperature of return water being recirculated through the recirculation loop 102. The third temperature sensor 120 is disposed about the recirculation pump 116. In the example shown in FIG. 1, the third temperature sensor 120 is positioned downstream from the recirculation pump 116. Other locations for the third temperature sensor 120 may be used, such as upstream of the recirculation pump 116.

Figure 2:
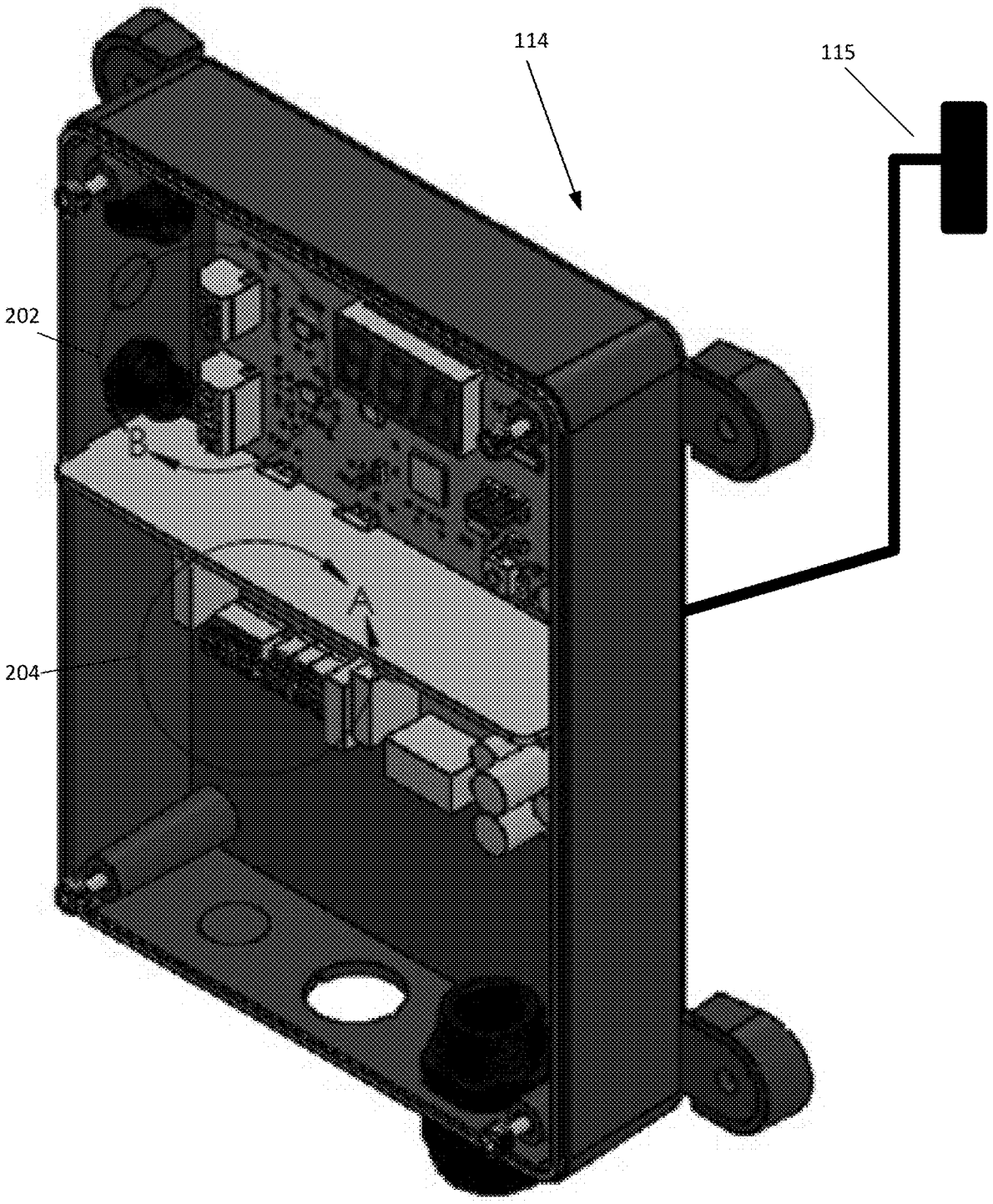
FIG. 2 is a system diagram of the recirculation controller.

FIG. 2 shows an implementation of the recirculation controller 114. In some implementations, the recirculation controller 114 contains circuits capable of receiving temperature sensor signals from a thermistor, thermocouple or any other type of temperature sensor that can sense temperature in a plumbing network. For example, the recirculation controller 114 comprises a first set of low voltage connectors 202. The low voltage connectors 202 include connectors for receiving a temperature signal from the temperature sensors 111, 118, 120, respectively.

The low voltage connectors 202 also include a data connector for communicating with the internal controller 104*c* of the water heater 104. For example, the data connector may be a serial connector, an ethernet port, or any other type of data connector for facilitating communication between the internal controller 104*c* of the water heater and the recirculation controller 114. As discussed in more detail below, the recirculation controller 114 may receive one or more error notifications from the internal controller 104*c* of the water heater 104 via the data connector.

Additionally, the recirculation controller 114 may receive internally monitored parameters of the water heater 104 from the internal controller 104*c*. For example, the internal controller 104*c* may monitor the exhaust temperature using the fourth temperature sensor 104*e*. The recirculation controller 114 may receive the exhaust temperature from the internal controller 104*c* via the data connector. The recirculation controller 114 may receive other internally monitored parameters of the water heater 104. In some implementations, the exhaust temperature may be directly measured by the recirculation controller 114 via a connection between the fourth temperature sensor 104*e* and one of the low voltage connectors 202.

The recirculation controller 114 performs the functions of controlling activation, deactivation, and/or speed of the recovery pump 108 and the recirculation pump 116. The recirculation controller 114 controls the operation of the recovery pump 108 and the recirculation pump 116 based on the signals received on the low voltage connectors 202. The recirculation controller 114 can perform the logic functions illustrated in FIGS. 3 and 4, described below.

The recirculation controller 114 comprises a first set of high voltage connectors 204. The high voltage connectors 204 include a supply voltage connection for receiving a supply voltage, such as from a power outlet. In some implementations the recirculation controller 114 has a single power chord 115 that attaches to a building power source. The recirculation controller 114 also supplies electrical power to the recovery pump 108 and the recirculation pump 116 so they do not need to obtain power from any other power source to run. For example, the high voltage connectors 204 include a first power connection between the recirculation controller 114 and the recovery pump 108 for supplying power for operation of the recovery pump 108. Likewise, the high voltage connectors 204 include a second power connection between the recirculation controller 114 and the recirculation pump 116 for supplying power for operation of the recirculation pump 116.

The recirculation controller 114 also includes a timer that can measure set time intervals and control the activation and deactivation of the recovery pump 108 or the recirculation pump 116 against these measured times. The recirculation controller 114 is capable of processing logic program functions to govern the control of the recovery pump 108 and the recirculation pump 116. In some implementations, the program functions are be based on user input values and measured values. The program functions calculate comparison values based on measured temperatures and configured offset values. The comparison values can be used to establish activation and deactivation thresholds.

Figure 3:
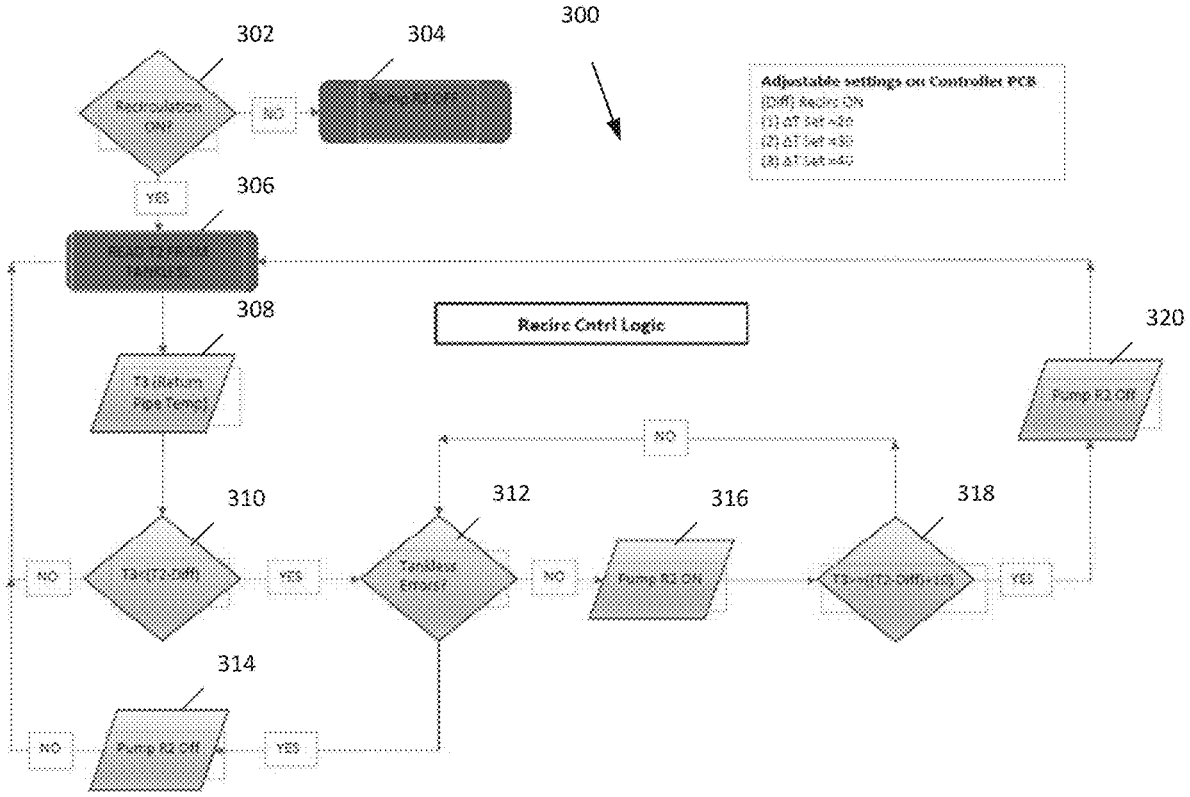
FIG. 3 is a flow chart of a recirculation method that is executed by the recirculation controller to control the operation of the recirculation pump.

FIG. 3 shows an implementation of a recirculation method 300 that is executed by the recirculation controller 114 to control the operation of the recirculation pump 116. At 302, the recirculation controller 114 determines whether there is an input to turn on the recirculation pump 116. For example, the input to turn on the recirculation pump 116 may be received from the timer on the recirculation pump 116, from a manually depressed button on a user interface of the recirculation controller 114, or from a wireless instruction received by the recirculation controller 114, such as from an application on a mobile device. In some implementations, the input to turn on the recirculation pump 116 is a configuration setting on the recirculation controller 114. Upon a determination that there is not input to turn on the recirculation pump 116, at 304, the recirculation controller 114 maintains the recirculation pump 116 in an off state. For example, the recirculation controller 114 does not supply power to the recirculation pump 116 from a corresponding one of the high voltage connectors 204.

Upon a determination that the recirculation controller 114 has received input to turn on the recirculation pump 116, the recirculation controller 114 reads a heater output temperature from the second temperature sensor 118, at 306. As noted above, the heater output temperature is a measurement of the setpoint temperature of the water heater 104. Likewise, at 308, the recirculation controller 114 reads the recirculation temperature from the third temperature sensor 120.

At 310, the recirculation controller 114 determines whether the recirculation temperature is less than a first comparison value. The first comparison value is the difference between the heater output temperature and a configured first offset temperature. The first offset temperature may be 20, 30, or 40 degrees, for example. In some implementations, other offset temperature values may be used. If the recirculation temperature is not less than the first comparison value, the method loops back to 306 and the recirculation controller 114 receives an updated heater output temperature and recirculation temperature. As noted above, the heater output temperature is a measure of the setpoint temperature of the water heater 104. Therefore, the determination at 310 ensures that the recirculation pump 116 is not turned on until the recirculation temperature is less than the first offset temperature from the setpoint temperature of the water heater 104. In one of the examples shown, the determination at 310 ensures that the recirculation temperature is at least 20 degrees less than the setpoint temperature of the water heater 104 before the recirculation pump 116 is turned on. Ensuring a temperature difference between the recirculation temperature and the setpoint temperature prevents the recirculation pump 116 from being short-cycled or otherwise turning on too frequently. Additionally, by tying the determination of when to turn on the recirculation pump 116 to a measurement of the setpoint temperature of the water heater 104, changes may be made to the setpoint on the water heater 104 and the method 300 will automatically adjust accordingly.

Otherwise, at 312, the recirculation controller 114 determines whether an error notification has been received from the internal controller 104*c* of the water heater 104. Upon a determination that the recirculation controller 114 has received an error notification from the internal controller 104*c* of the water heater 104, the recirculation controller 114 turns off or otherwise maintains the recirculation pump 116 in an off state at 314 and the method 300 loops back to 306. Therefore, rather than running the recirculation pump 116 when the water heater 104 is not able to supply hot water or otherwise experiencing an error, the method 300 ensures that the recirculation pump 116 is turned off upon the water heater 104 entering an error state and communicating an error notification. Accordingly, the method 300 prevents the recirculation pump 116 from simply circulating cold water through the hot water recirculation loop 102. Upon a determination that the recirculation controller 114 has not received any error notifications from the internal controller 104*c* of the water heater 104, the recirculation controller 114 turns on or otherwise maintains the recirculation pump 116 in an on state at 316.

At 318, the recirculation controller 114 determines whether the recirculation temperature is greater than or equal to a second comparison value that is determined based on the heater output temperature and the first offset temperature. The second comparison value is greater than the first comparison value and less than the heater output temperature. In the example shown in FIG. 3, the second comparison value is determined based on adding a second offset temperature to the first comparison value. In the example shown, the second offset temperature is 10 degrees Fahrenheit. Other second offset temperature values may be used.

If the recirculation temperature is not greater than or equal to the comparison value, the method 300 loops back to 312 and the recirculation pump 116 continues running if no error notifications are received from the internal controller 104*c* of the water heater 104. Otherwise, upon a determination that the recirculation temperature is high enough, the recirculation controller 114 turns off the recirculation pump 116 at 320. For example, the recirculation controller 114 may discontinue providing power through a corresponding one of the high voltage connectors 204 to the recirculation pump 116. Turning off the recirculation pump 116 when the recirculation temperature is greater than the first comparison value and less than the setpoint temperature ensures that hot water has been circulated through the hot water recirculation loop 102 and ensures that the recirculation pump 116 will not be turned back on right away. Again, by tying the determination of when to turn off the recirculation pump 116 to a measurement of the setpoint temperature of the water heater 104, changes may be made to the setpoint on the water heater 104 and the method 300 will adjust accordingly.

In some implementations, if the recirculation controller 114 receives an input to stop the method 300 during or between any of the steps above, the recirculation controller 114 turns off the recirculation pump 116. In some implementations, the input to stop the method 300 may be manually entered or may be automatically input by a timer-activated deactivation input.

Figure 4:
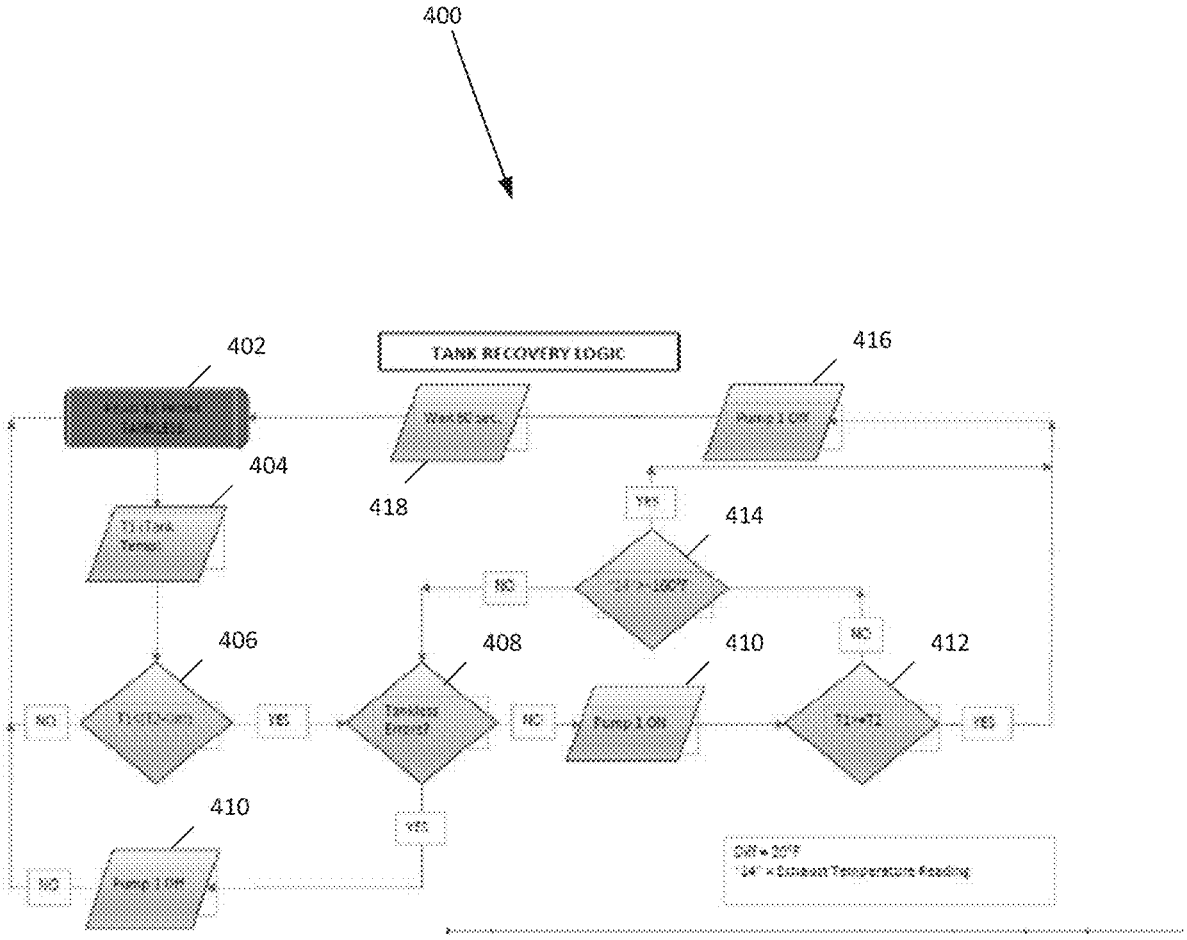
FIG. 4 is a flow chart of a recovery method that is executed by the recirculation controller to control the operation of the recovery pump.

FIG. 4 shows an implementation of a recovery method 400 that is executed by the recirculation controller 114 to control the operation of the recovery pump 108. At 402, the recirculation controller 114 receives the heater output temperature from the second temperature sensor 118. At 404, the recirculation controller 114 receives the tank temperature from the first temperature sensor 111. At 406, the recirculation controller 114 determines whether the tank temperature is less than the difference between the heater output temperature and a configured third offset temperature. The third offset temperature may be 20, 30, or 40 degrees, for example. In some implementations, other offset temperature values may be used. If the tank temperature is not less than the difference between the heater output temperature and the third offset temperature, the method loops back to 402 and the recirculation controller 114 receives an updated heater output temperature and tank temperature.

Otherwise, at 408, the recirculation controller 114 determines whether an error notification has been received from the internal controller 104*c* of the water heater 104. Upon a determination that the recirculation controller 114 has received an error notification from the internal controller

104*c* of the water heater 104, the recirculation controller 114 turns off or otherwise maintains the recovery pump 108 in an off state at 410 and the method 400 loops back to 402. For example, the recirculation controller 114 may discontinue providing power through a corresponding one of the high voltage connectors 204 to the recovery pump 108. Therefore, the method 400 prevents using the recovery pump 108 to simply circulate cold water between the storage tank 110 and the water heater 104 upon the event of an error on the water heater 104.

Upon a determination that the recirculation controller 114 has not received an error notification from the internal controller 104*c* of the water heater 104, the recirculation controller 114 turns on the recovery pump 108 at 410. For example, the recirculation controller may provide power through a corresponding one of the high voltage connectors to the recovery pump 108.

At 412, the recirculation controller 114 determines whether the tank temperature is greater than or equal to the heater output temperature. If not, at 414, the recirculation controller 114 determines whether an exhaust temperature of an exhaust on the water heater 104 is greater than a threshold exhaust temperature. For example, as discussed above, the recirculation controller 114 may receive the exhaust temperature measured by the fourth temperature sensor 104*e* from the internal controller 104*c* via the data connector of the low voltage connectors 202. The threshold exhaust temperature may be 160° F. Other threshold exhaust temperatures may be used depending on the materials in the vent stack 104*d*. If the exhaust temperature is greater than the threshold exhaust temperature, the recirculation controller 114 turns off or otherwise maintains the recovery pump 108 in an off state at 416 and the method 400 continues to 418. For example, the recirculation controller 114 may discontinue providing power through a corresponding one of the high voltage connectors 204 to the recovery pump 108. By ensuring that the exhaust temperature remains below the threshold exhaust temperature during operation of the recovery pump 108, the method 400 ensures that the exhaust vent is not damaged during operation of the recovery pump 108.

Returning to 412, upon the recirculation controller 114 determining that the tank temperature is greater than or equal to the heater output temperature, the recirculation controller 114 turns off the recovery pump at 416, as described above. At 418, the recirculation controller waits for a predetermined time delay before looping back to 402. For example, the predetermined time delay may be 60 seconds, five minutes, or any other suitable time delay. By providing a time delay, the recirculation controller 114 ensures that the recovery pump 108 is not turned on again soon after being turned off. For example, the time delay provides time for the exhaust temperature to lower below the threshold exhaust temperature. In some implementations, if the recirculation controller 114 receives an input to stop method 400 during or between any of the steps above, the controller 114 turns off the recovery pump 108. In some implementations, this input to stop the method 400 may be manually entered or may be automatically input by a timer-activated deactivation input.

Figure 5:
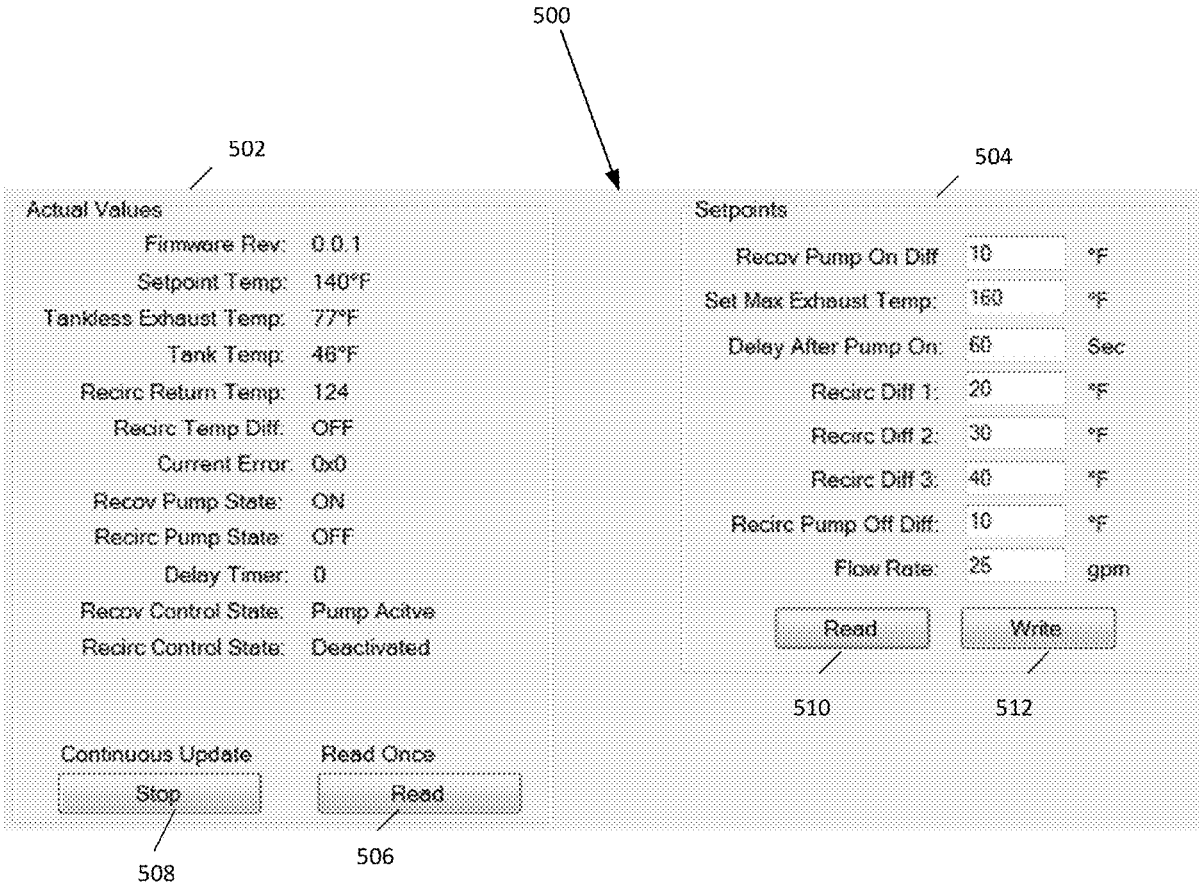
FIG. 5 is a configuration user interface to monitor and configure parameters of the recirculation controller.

FIG. 5 shows an implementation of a configuration user interface 500 to monitor and configure parameters of the recirculation controller 114. The user interface 500 includes a set of monitored values 502 that are measured or received from the internal controller 104*c* by the recirculation controller 114. For example, the user interface 500 may include the setpoint temperature of the water heater 104, the exhaust temperature, the tank temperature, the recirculation temperature, the difference between the setpoint temperature and the first offset temperature, a current error code or error notification, an operating state of the recovery pump 108 (e.g., on or off), an operating state of the recirculation pump 116 (e.g., on or off), a delay timer value, a control state of the recovery pump 108 (e.g., whether method 400 determines to activate or deactivate the recovery pump 108), and a control state of the recirculation pump 116 (e.g., whether method 300 determines to activate or deactivate the recirculation pump 116.

The user interface 500 also includes a set of editable configuration values 504 for configuring operation of the recirculation controller 114. For example, the configuration values 504 may include the third offset temperature value, the threshold exhaust temperature, the time delay, multiple values for the first offset temperature can be set for functions of the recirculation pump 116, the second offset temperature value, and a flow rate of the recirculation pump 116 Although FIG. 5 shows configurable parameters for the control functions mentioned above, in some implementations, the user interface 500 can configure other parameters of the hot water circulation system 100.

The user interface 500 includes a plurality of selectable buttons for operation of reading and writing values monitored or configured on the user interface 500. For example, upon selection of a first selectable button 506, the monitored values 502 may be read once from the recirculation controller 114. Upon selection of a second selectable button 508, continuous reading of the monitored values 502 may be toggled to stop or start. Upon selection of a third selectable button 510, current values of the configuration values 504 may be read from the recirculation controller 114. Upon selection of a fourth selectable button 512, edited values of the configuration values 504 are written to the recirculation controller 114.

Figure 6:
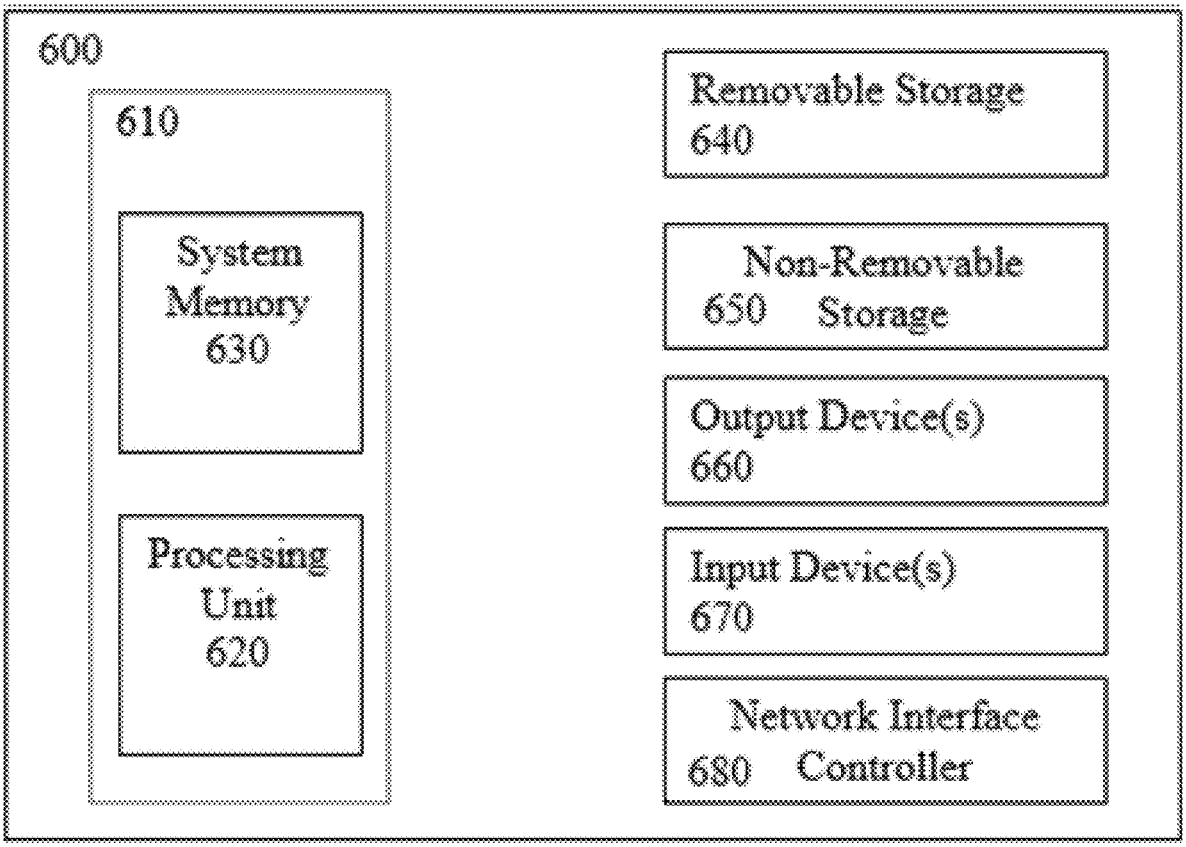
FIG. 6 shows an implementation of an example computing device.

FIG. 6 shows an example computing device 600. It should be appreciated that the logical operations described herein with respect to the various figures may be implemented (1) as a sequence of computer implemented acts or program modules (i.e., software) running on a computing device (e.g., the computing device described in FIG. 6), (2) as interconnected machine logic circuits or circuit modules (i.e., hardware) within the computing device and/or (3) a combination of software and hardware of the computing device. Thus, the logical operations discussed herein are not limited to any specific combination of hardware and software. The implementation is a matter of choice dependent on the performance and other requirements of the computing device. Accordingly, the logical operations described herein are referred to variously as operations, structural devices, acts, or modules. These operations, structural devices, acts and modules may be implemented in software, in firmware, in special purpose digital logic, and any combination thereof. It should also be appreciated that more or fewer operations may be performed than shown in the figures and described herein. These operations may also be performed in a different order than those described herein.

Referring to FIG. 6, an example computing device 600 upon which embodiments of the invention may be implemented is illustrated. For example, each of the internal controller 104*c* of the water heater 104 and the recirculation controller 114 described herein may be implemented as a computing device, such as computing device 600. It should be understood that the example computing device 600 is only one example of a suitable computing environment upon which embodiments of the invention may be implemented. Optionally, the computing device 600 can be a well-known computing system including, but not limited to, personal computers, servers, handheld or laptop devices, multiprocessor systems, microprocessor-based systems, network personal computers (PCs), minicomputers, mainframe computers, embedded systems, and/or distributed computing environments including a plurality of any of the above systems or devices. Distributed computing environments enable remote computing devices, which are connected to a communication network or other data transmission medium, to perform various tasks. In the distributed computing environment, the program modules, applications, and other data may be stored on local and/or remote computer storage media.

In an embodiment, the computing device 600 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computing device 600 to provide the functionality of a number of servers that is not directly bound to the number of computers in the computing device 600. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In its most basic configuration, computing device 600 typically includes at least one processing unit 620 and system memory 630. Depending on the exact configuration and type of computing device, system memory 630 may be volatile (such as random access memory (RAM)), non-volatile (such as read-only memory (ROM), flash memory, etc.), or some combination of the two. This most basic configuration is illustrated in FIG. 6 by dashed line 610. The processing unit 620 may be a standard programmable processor that performs arithmetic and logic operations necessary for operation of the computing device 600. While only one processing unit 620 is shown, multiple processors may be present. Thus, while instructions may be discussed as executed by a processor, the instructions may be executed simultaneously, serially, or otherwise executed by one or multiple processors. The computing device 600 may also include a bus or other communication mechanism for communicating information among various components of the computing device 600.

Computing device 600 may have additional features/functionality. For example, computing device 600 may include additional storage such as removable storage 640 and non-removable storage 650 including, but not limited to, magnetic or optical disks or tapes. Computing device 600 may also contain network connection(s) 680 that allow the device to communicate with other devices such as over the communication pathways described herein. The network connection(s) 680 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. Computing device 600 may also have input device(s) 660 such as a keyboards, keypads, switches, dials, mice, track balls, touch screens, voice recognizers, card readers, paper tape readers, or other well-known input devices. Output device(s) 660 such as a printers, video monitors, liquid crystal displays (LCDs), touch screen displays, displays, speakers, etc. may also be included. The additional devices may be connected to the bus in order to facilitate communication of data among the components of the computing device 600. All these devices are well known in the art and need not be discussed at length here.

The processing unit 620 may be configured to execute program code encoded in tangible, computer-readable media. Tangible, computer-readable media refers to any media that is capable of providing data that causes the computing device 600 (i.e., a machine) to operate in a particular fashion. Various computer-readable media may be utilized to provide instructions to the processing unit 620 for execution. Example tangible, computer-readable media may include, but is not limited to, volatile media, non-volatile media, removable media and non-removable media implemented in any method or technology for storage of information such as computer readable instructions, data structures, program modules or other data. System memory 630, removable storage 640, and non-removable storage 650 are all examples of tangible, computer storage media. Example tangible, computer-readable recording media include, but are not limited to, an integrated circuit (e.g., field-programmable gate array or application-specific IC), a hard disk, an optical disk, a magneto-optical disk, a floppy disk, a magnetic tape, a holographic storage medium, a solid-state device, RAM, ROM, electrically erasable program read-only memory (EEPROM), flash memory or other memory technology, CD-ROM, digital versatile disks (DVD) or other optical storage, magnetic cassettes, magnetic tape, magnetic disk storage or other magnetic storage devices.

It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

In an example implementation, the processing unit 620 may execute program code stored in the system memory 630. For example, the bus may carry data to the system memory 630, from which the processing unit 620 receives and executes instructions. The data received by the system memory 630 may optionally be stored on the removable storage 640 or the non-removable storage 650 before or after execution by the processing unit 620.

It should be understood that the various techniques described herein may be implemented in connection with hardware or software or, where appropriate, with a combination thereof. Thus, the methods and apparatuses of the presently disclosed subject matter, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computing device, the machine becomes an apparatus for practicing the presently disclosed subject matter. In the case of program code execution on programmable computers, the computing device generally includes a processor, a storage medium readable by the processor (including volatile and non-volatile memory and/or storage elements), at least one input device, and at least one output device. One or more programs may implement or utilize the processes described in connection with the presently disclosed subject matter, e.g., through the use of an application programming interface (API), reusable controls, or the like. Such programs may be implemented in a high level procedural or object-oriented programming language to communicate with a computer system. However, the program(s) can be implemented in assembly or machine language, if desired. In any case, the language may be a compiled or interpreted language and it may be combined with hardware implementations.

Embodiments of the methods and systems may be described herein with reference to block diagrams and flowchart illustrations of methods, systems, apparatuses and computer program products. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A building recirculation system for operation with a water heating system with a water heater, a storage tank, and a recovery pump for circulating water between the water heater and the storage tank, wherein a first temperature sensor is configured to measure a water heater output temperature of the water heater, the building recirculation system comprising:

a recirculation controller;

a second temperature sensor configured to measure a recirculation temperature of a building recirculation return pipe;

a building recirculation pump configured to circulate water through a plumbing network of a building to the building recirculation return pipe, wherein the recirculation controller is configured to receive the water heater output temperature of the water heater from the first temperature sensor, and the recirculation temperature of the building recirculation return pipe from the second temperature sensor;

wherein the recirculation controller is configured to control the building recirculation pump based on the water heater output temperature and the recirculation temperature.

2. The building recirculation system of claim 1, wherein the recirculation controller is configured to turn off the building recirculation pump upon a determination that the recirculation temperature is at least at a comparison value that is based on the water heater output temperature.

3. The building recirculation system of claim 2, wherein the recirculation controller is further configured to maintain operation of the building recirculation pump upon a determination the recirculation temperature is less than the comparison value.

4. The building recirculation system of claim 2, wherein the recirculation controller is configured to calculate the comparison value based on an offset value from the water heater output temperature.

5. The building recirculation system controller of claim 4, wherein the offset value is ten to thirty degrees.

6. The building recirculation system of claim 1, wherein the recirculation controller is configured to turn off the building recirculation pump in response to receiving a water heater error notification from an internal controller of the water heater.

7. A building recirculation system for operation with a water heating system, wherein a first temperature sensor is configured to measure a water heater output temperature of the water heater, the building recirculation system comprising:

a building recirculation pump, having an inlet and an outlet, wherein the inlet of the building recirculation pump is configured to be coupled to an outlet of the plumbing network, and wherein the outlet of the building recirculation pump is configured to be fluidically coupled with a water heater;

a second temperature sensor configured to measure a recirculation temperature about the building recirculation pump;

a building recirculation controller;

wherein the building recirculation controller is configured to receive the water heater output temperature of the water heater from the first temperature sensor, and the building recirculation temperature from the second temperature sensor;

wherein the building recirculation controller is configured to control the building recirculation pump based on the water heater output temperature and the recirculation temperature.

8. The building recirculation system of claim 7, wherein the building recirculation controller is configured to turn off the building recirculation pump upon a determination that the recirculation temperature is at least a comparison value, wherein the comparison value is based on the heater output temperature.

9. The building recirculation system of claim 8, wherein the building recirculation controller is further configured to maintain operation of the building recirculation pump upon a determination the recirculation temperature is less than the comparison value.

10. The building recirculation system of claim 7, wherein the water heating system further comprises an internal controller, wherein the building recirculation controller is configured to turn off the building recirculation pump in response to receiving a water heater error notification from the internal controller.

11. The building recirculation system of claim 10, wherein the water heater internal controller is in electrical communication with the building recirculation controller.

12. The building recirculation system of claim 7, wherein the water heating system comprises a water heater, a storage tank, a recovery pump for circulating water between the water heater and the storage tank, and a third temperature sensor, configured to measure a storage tank temperature inside the storage tank, wherein the building recirculation controller is configured to activate the recovery pump upon a determination that the water heater output temperature exceeds the storage tank temperature by a predetermined value.

13. The hot water circulation system of claim 12, wherein the building recirculation controller is further configured to maintain functions of the building recirculation pump, in response to the recirculation temperature.

14. The building recirculation system of claim 12, wherein the building recirculation controller is further configured to compare the storage tank temperature to a comparison value, wherein the comparison value is calculated using the water heater output temperature and an offset value to determine whether to run the recovery pump and the building recirculation pump.

15. The building recirculation system of claim 14, wherein the comparison value is the water heater output temperature, minus the comparison value, plus ten degrees.

16. The building recirculation system of claim 7, wherein the water heater is activated by a fluid flow produced from the building recirculation pump.

17. A method of providing hot water, the method comprising:

receiving an input to activate a building recirculation pump;

receiving a heater output temperature from a first temperature sensor, wherein the first temperature sensor is disposed downstream of a water heater output;

receiving a recirculation temperature from a second temperature sensor, wherein the second temperature sensor is disposed about a building recirculation pump at an outlet of a plumbing network of a building;

comparing the recirculation temperature to a comparison value that is calculated based on the heater output temperature;

maintaining operation of the building recirculation pump upon a determination that the recirculation temperature is less than the comparison value; and turning off the building recirculation pump upon a determination that the recirculation temperature is at least at the comparison value.

18. The method of claim 17, further comprising turning off the building recirculation pump in response to receiving a water heater error notification from a water heater internal controller.

19. The method of claim 18, further comprising turning off the building recirculation pump after a set time interval.

* * * * *